US005935382A

United States Patent [19]

Huovila et al.

[11] Patent Number: 5,935,382

[45] Date of Patent: Aug. 10, 1999

[54] METHOD AND BOARD MACHINE FOR MANUFACTURING A PAPERBOARD WEB

[75] Inventors: Vesa Tapani Huovila, Tampere, Finland; Nils Börje Sandgren, Karlstad, Sweden

[73] Assignee: Valmet-Karlstad AB, Karlstad, Sweden

[21] Appl. No.: 08/866,557

[22] Filed: May 30, 1997

Related U.S. Application Data

[60] Provisional application No. 60/024,747, Aug. 28, 1996.

[30] Foreign Application Priority Data

May 31, 1996 [SE] Sweden ..... 9602138

[51] Int. Cl.[6] ..... D21F 11/00; D21F 1/00

[52] U.S. Cl. ..... 162/123; 162/133; 162/125; 162/298; 162/300; 162/304; 162/DIG. 7; 162/352

[58] Field of Search ..... 162/123, 133, 162/125, 301, 299, 298, 303, 304, DIG. 7, 352, 354, 300

[56] References Cited

U.S. PATENT DOCUMENTS

| | | | |
|---|---|---|---|
| 2,881,670 | 4/1959 | Thomas | 162/299 |
| 2,881,672 | 4/1959 | Thomas | 162/203 |
| 3,992,252 | 11/1976 | Coleman | 162/266 |
| 4,961,824 | 10/1990 | Laitinen et al. . | |
| 4,988,408 | 1/1991 | Evälahti | 162/301 |
| 5,045,153 | 9/1991 | Sollinger et al. | 162/301 |
| 5,074,964 | 12/1991 | Partanen . | |
| 5,190,090 | 3/1993 | Corbellini et al. | 162/190 |
| 5,262,010 | 11/1993 | Bubik et al. | 162/352 |
| 5,427,654 | 6/1995 | Gray et al. . | |
| 5,486,270 | 1/1996 | Schiel | 162/352 |
| 5,507,918 | 4/1996 | Polifke et al. | 162/301 |
| 5,554,267 | 9/1996 | Grossmann et al. | 162/301 |
| 5,584,967 | 12/1996 | Grossmann et al. | 162/304 |

FOREIGN PATENT DOCUMENTS

| | | |
|---|---|---|
| 0 233 058 B1 | 2/1987 | European Pat. Off. . |
| 0 511 185 A1 | 4/1992 | European Pat. Off. . |
| 0 511 186 A1 | 4/1992 | European Pat. Off. . |
| WO 92/06242 | 4/1992 | WIPO . |

OTHER PUBLICATIONS

T. Waris, A headbox for high consistency forming, Paper Technology 31, No. 2:14–18 (Feb., 1990).

*Primary Examiner*—Stanley S. Silverman
*Assistant Examiner*—Jose A. Fortuna
*Attorney, Agent, or Firm*—Alston & Bird LLP

[57] ABSTRACT

In order to meet higher demands for the properties of paperboard products an improved method and machine for the manufacture of paperboard are proposed according to the present invention in which a core of a paperboard web is formed in a second forming unit from a stock with a consistency of 1.5–6.0% being supplied to the fourdrinier wire of a fourdrinier former carrying a back layer formed previously in a first forming unit, from a headbox for high consistency stock and being dewatered upon being enclosed between the fourdrinier wire and a top wire in said second forming unit, and in which an underliner is formed in a third forming unit of stock with a consistency of 0.3–1.4% being supplied to the fourdrinier wire carrying the back layer and core, from a headbox for stock of low consistency. In both cases dewatering occurs under the influence of upper and lower tables in the loop of respective top wires, said tables having slats separated by spaces and defining between them a passage through which a sandwich structure consisting of the fourdrinier wire, top wires and stock layer is conveyed and influenced alternatively by upper and lower slats so that the stock layer is compressed alternately from above and below, pressure pulses and shear forces thus being created in the stock layer. Furthermore, in the second forming unit for high consistency forming the stock layer is kept in a fluidized state.

16 Claims, 4 Drawing Sheets

METHOD AND BOARD MACHINE FOR MANUFACTURING A PAPERBOARD WEB

CROSS-REFERENCE TO RELATED APPLICATIONS

This application claims the benefit of U.S. Provisional Application No. 60/024,747, filed Aug. 28, 1996.

FIELD OF THE INVENTION

The present invention relates to papermaking machines and associated methods, and more particularly relates to papermaking machines and methods for manufacturing paperboard webs.

BACKGROUND OF THE INVENTION

The development in the paper industry is towards increasingly high demands on paperboard products manufactured. This applies both to the demand on mechanical properties and also to the ability of the material to produce a good printing result. New regulations for recovery increase demands for use of recycled fibers to a greater extent. This implies that ever poor fibers shall be used to produce paperboard products with ever high demands for quality.

A vast number of methods and machines for manufacturing paperboard are described in the literature and have been used in practice with greater or lesser success. The following may be mentioned by way of example: EP-0 511 186 A1, WO 92/06242, U.S. Pat. No. 4,961,824, EP-0 511 185 A1, U.S. Pat. No. 5,074,964, EP-0 233 058 B1 and the article entitled "Headbox for High-Consistency Forming" in Paper Technology 31, No. 2:14–18(February 1990). Common to these methods and machines is that they cannot easily fulfil the requirements mentioned above, particularly in the case of manufacturing folding boxboard which is composed of a top layer, an underliner, a bulky core and a back layer, where it is particularly important for the core to have the best possible properties, such as formation, bulk and grammage profile, and for the underliner to have such uniformity that the top layer formed thereon will have the best possible printability.

The object of the invention is to provide an improved method of manufacturing paperboard and an improved board machine enabling the increasingly high demands placed on paperboard products to be met.

SUMMARY OF THE INVENTION

The method according to the present invention is characterized in that the core is formed by stock with a consistency of 1.5–6.0%, preferably 2.5–3.5%, being supplied to the fourdrinier wire carrying the back layer (formed previously in the first forming unit) from a headbox for high consistency stock, and is dewatered upon being enclosed between the fourdrinier wire and a top wire of a second forming unit. The core stock is dewatered under the influence of an upper table having slats separated by spaces, in the loop of the top wire, and a lower table having slats separated by spaces, in the loop of the fourdrinier wire, said tables defining between them a passage for a first sandwich structure consisting of the top wire, fourdrinier wire and the layers of stock enclosed therebetween. The first sandwich structure is influenced alternately by the slats of the upper table and the slats of the lower table so that the stock layer supplied from the headbox is compressed alternately from above and below, thereby being maintained in a fluidized state and pressure pulses and shear forces are created in the stock layer. The underliner is formed by stock of a consistency of 0.3–1.4%, preferably 0.5–1.0%, being supplied to the fourdrinier wire carrying the previously formed back layer and core, from a headbox for stock of low consistency, and is dewatered upon being enclosed between the fourdrinier wire and a top wire of a third forming unit. The underliner stock is dewatered under the influence of an upper table having slats separated by spaces, in the loop of the top wire and a lower table having slats separated by spaces, in the loop of the fourdrinier wire, said tables defining between them a passage for a second sandwich structure consisting of the top wire, fourdrinier wire and the layers of stock enclosed therebetween. The second sandwich structure is influenced alternately by the slats of the upper table and the slats of the lower table so that the stock layer supplied from the headbox is compressed alternately from above and below, thereby creating pressure pulses and shear forces in the stock layer.

The board machine according to the invention is characterized in that said second forming unit comprises a headbox for stock with a consistency of 1.5–6.0%, preferably 2.5–3.5%, a top wire running in a loop having a run cooperating with the fourdrinier wire, and dewatering means comprising an upper table arranged on the lower side of a housing containing suction chambers located in the loop of the top wire, and a lower table arranged on a stand in the loop of the fourdrinier wire. The tables comprise a plurality of slats separated by spaces, the slats of the upper table and the slats of the lower table being arranged opposite each other's spaces and the tables defining between them a passage for a first sandwich structure consisting of the top wire, fourdrinier wire and the two layers of stock enclosed therebetween. The third forming unit comprises a headbox for low consistency stock with a consistency of 0.3–1.4%, preferably 0.5–1.0%, a top wire running in a loop and having a run that cooperates with the fourdrinier wire, and dewatering means comprising an upper table arranged on the lower side of a housing containing suction chambers located in the loop of the top wire, and a lower table arranged on a stand in the loop of the fourdrinier wire. The tables comprise a plurality of slats separated by spaces and defining between them a passage for a second sandwich structure consisting of the top wire, fourdrinier wire and the three layers of stock enclosed therebetween.

The forming process for the core provides considerable improvement with regard to formation, surface structure and bulk and enables the use of recycled fibers with high dewatering resistance. The forming process for the underliner provides good forming as well as evening out unevennesses in the middle or core formed thereon since more fibers from the underliner will be collected in areas with little fibre material resulting in pits, whereas less fibers from the underliner will be collected in areas with much material resulting in elevations. This means that the surface of the underliner becomes very uniform, thus creating favorable conditions for the formation of a surface layer with a smooth outer side thereby fulfilling high requirements for printability.

BRIEF DESCRIPTION OF THE DRAWINGS

The invention will be described in more detail in the following with reference to the drawings.

DETAILED DESCRIPTION OF THE INVENTION

Figure 1:
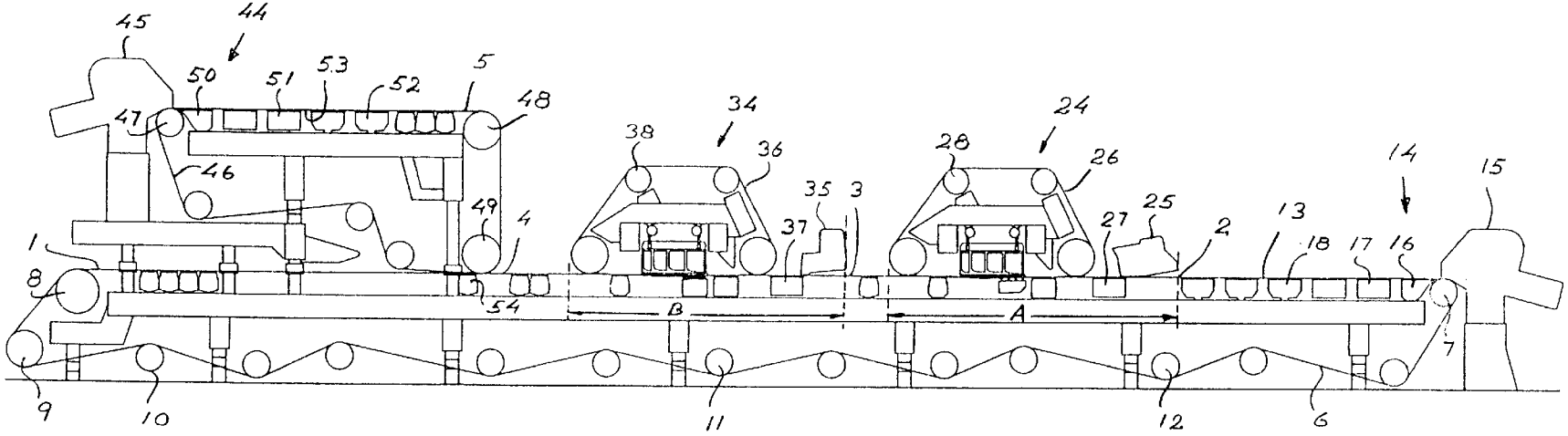
FIG. 1 shows the wet end of a board machine with fourdrinier former and four different forming units for manufacturing a four-layer paperboard web according to the invention.

FIG. 1 shows schematically a wet end in a board machine for manufacturing a paperboard web 1 composed of four layers—a back layer 2, a core 3, an underliner 4 and a surface or top layer 5. The wet end comprises an extended fourdrinier former having a fourdrinier wire 6 running in a loop around an upstream breast roll 7, a downstream suction couch 8, a wire running roll 9 and a plurality of guide rolls 10 consisting of alignment and tension rolls 11 and 12, respectively. The stock-dewatering and web-forming upper run 13 of the fourdrinier wire 6 between the breast roll 7 and suction couch 8 is flat and horizontal except in certain sections, as will be explained below.

The wet end comprises a plurality of forming units for forming said layers. In the embodiment shown a first forming unit 14 comprises said fourdrinier wire 6 and a headbox 15 arranged near the breast roll 7 to supply a jet of stock on the upper run 13 of the fourdrinier wire 6, said stock having a consistency of 0.2–0.6%. The fourdrinier former has a fourdrinier forming section comprising a forming table 16 and hydrofoils 17. Suction boxes 18 are arranged after the fourdrinier forming section, on the lower side of the flat draw 13 of the fourdrinier wire, in order to dewater the stock, thereby producing a first layer 2, designated the back layer, having a consistency of about 6–15%, preferably 8–12%.

Figure 2:
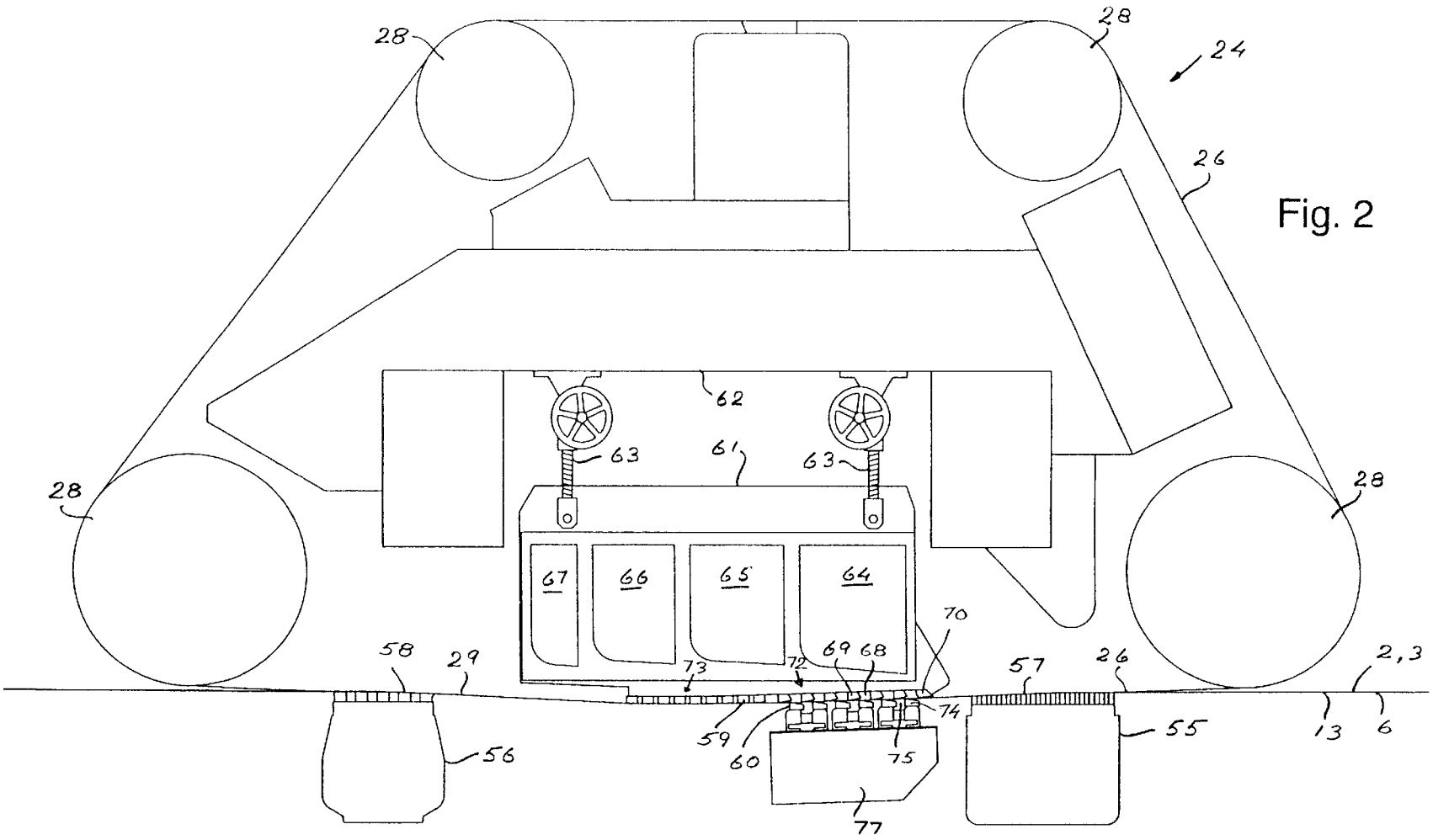
FIG. 2 shows parts of the second forming unit of the wet end according to FIG. 1.

The wet end comprises a second forming unit 24 for forming a second layer 3, designated the core or core layer, in cooperation with the upper run 13 of the fourdrinier wire 6 within a first section A of the fourdrinier former. The second forming unit 24 comprises a headbox 25, a top wire 26 and dewatering means. Downstream of the headbox 25 is a support table 27 for the fourdrinier wire 6. As can be seen in FIG. 2, the top wire 26 runs over a plurality of guide rolls 28 and in an accompanying run 29 within said section A for cooperation with the upper run 13 of the fourdrinier wire 6. The headbox 25 of the second forming unit 24 is designed to emit a jet of stock with high consistency within the interval 2.5–3.5%, in order to form the core 3 on the previously formed back layer 2 carried by the fourdrinier wire 6. The dewatering means of the second forming unit 24 dewater the stock so that the two-layer web 2, 3 formed has a consistency of 6–15%, preferably 8–12%.

Figure 4:
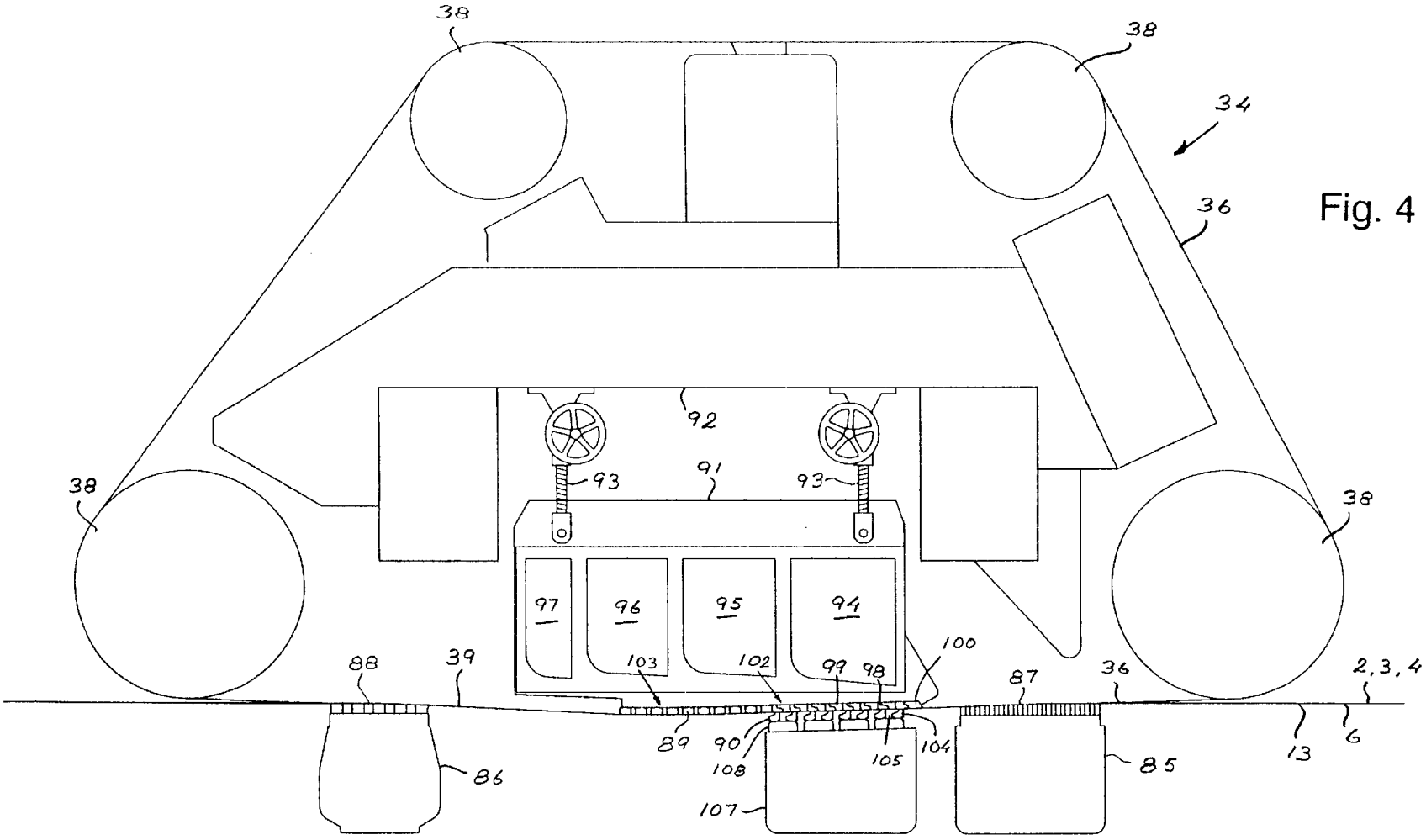
FIG. 4 shows parts of the third forming unit of the wet end according to FIG. 1.

The wet end also has a third forming unit 34 for forming a third layer 4, designated the underliner or underliner layer, in cooperation with the upper run 13 of the fourdrinier wire 6 within a second section B of the fourdrinier former. The third forming unit 34 comprises a headbox 35, a top wire 36 and dewatering means. Downstream of the headbox 35 is a support table 37 for the fourdrinier wire 6. As can be seen in FIG. 4, the top wire 36 runs over a plurality of guide rolls 38 and in an accompanying run 39 within said section B for cooperation with the upper run 13 of the fourdrinier wire 6. The headbox 35 of the third forming unit 34 is designed to emit a jet of stock with low consistency within the interval 0.5–1.0%, in order to form the underliner 4 on the previously formed two-layer web 2, 3, carried by the fourdrinier wire 6. The dewatering means in the third forming unit dewater the stock so that the three-layer web 2, 3, 4 formed has a consistency of 6–15%, preferably 8–12%.

Finally, the wet end has a fourth forming unit 44 for forming a fourth layer 5, designated the surface layer or top layer. This forming may take place in cooperation with the upper run 13 of the fourdrinier wire 6 within a third section of the fourdrinier former and using a forming unit similar to the third forming unit 34. In the alternative embodiment shown the fourth forming unit 44 comprises a short upper fourdrinier wire 46, running in a loop around a breast roll 47, and upper guide roll 48 and a lower guide roll 49, the lower guide roll 49 being arranged close to the upper run 13 of the fourdrinier wire 6 of the fourdrinier former in order to couch together the surface layer 5 formed, with the three-layer web 2, 3, 4. The fourth forming unit 44 comprises a headbox 45 arranged near the breast roll 47 to emit a jet of stock onto the upper flat run 53 of the fourdrinier wire 46, said stock having a consistency of 0.2–0.6%. A forming table 50 and hydrofoils 51 follow the breast roll 47. Suction boxes 52 are arranged downstream of the hydrofoils 51, on the lower side of the flat run 53 of the fourdrinier wire 46, in order to dewater the stock, thereby forming said surface layer 5 with a consistency of 6–15%, preferably 8–12%. A suction box 54 of the extended fourdrinier former causes the four-layer web to adhere to the lower fourdrinier wire 6 so that the web can subsequently be transferred at the suction couch 8 to the press section of the board machine.

As best shown in FIG. 2, the dewatering means in the second forming unit 24 comprise a leading suction box 55 arranged below the fourdrinier wire 6 at the beginning of the run 29 of the top wire 26 along the fourdrinier wire 6, and a separation suction box 56 arranged below and along the fourdrinier wire 6 at the end of the run 29 of the top wire 26 where the top wire 26 leaves the fourdrinier wire 6, so that the two-layer web 2, 3 accompanies the fourdrinier wire 6 forwards. Said two suction boxes 55, 56 have curved surfaces 57, 58, along which the fourdrinier wire 6 slides, the downstream end of the leading suction box 55 and the upstream end of the separating suction box 56 being arranged below a reference plane at a tangent to the breast roll 7 and suction couch 8.

The dewatering means also comprise an upper dewatering table 59 located in the loop of the top wire 26, and a lower dewatering table 60 located in the loop of the fourdrinier wire 6. The tables 59, 60 define a passage between them, through which the fourdrinier wire 6 and top wire 26, enclosing the two-layer web 2, 3 between them, pass in sliding contact with the tables 59, 60. The upper table 59 is arranged on the lower side of a housing 61 suspended in a stand 62 via adjustment means 63 enabling the upstream and downstream ends of the table 59 to be raised and lowered independently of each other in order to incline the table 59 in relation to a reference plane at a tangent to the breast roll 7 and suction couch 8, and also enabling the table 59 as a whole to be lowered and set at a level below said reference plane so that the top wire 26 and fourdrinier wire 6 are bent downwards and brought into sliding contact with the curved surfaces 57, 58 of the suction boxes 55, 56.

Figure 3:
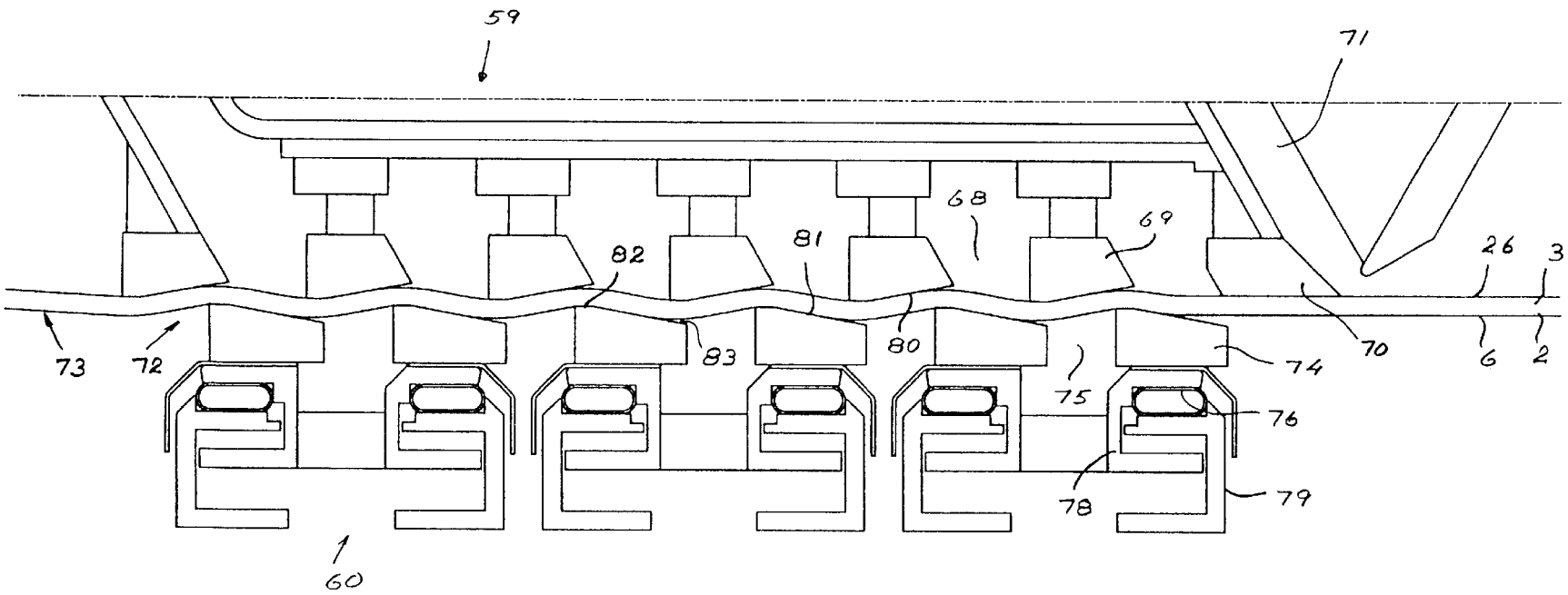
FIG. 3 is an enlarged detail of dewatering means in the second forming unit according to FIG. 2.

In the embodiment shown, the housing 61 comprises four suction chambers 64, 65, 66, 67 to collect the white water pressed up through the top wire 26 due to the suction action. The upper table 59 comprises a plurality of slats 69, fixed in relation to the housing 61 and separated by spaces 68, whereby each suction chamber, except for the first one, is in open communication with its own group of spaces 68 in order to suck up the white water pressed out of the core 3 through the top wire 26. As best seen in FIG. 3, the upstream end of the upper table 59 has a slat 70 which scrapes gently against the top wire 26 in order to deflect the white water that collects on the upper side of the top wire as it passes said leading suction box 55, to the first suction chamber 64 as seen in FIG. 2 via an autoslice 71. The upper table 59 has a first or leading straight zone 72 and a second or final curved zone 73 with large radius.

The lower table 60 is located opposite the leading straight zone 72 of the upper table 59, and comprises a plurality of slats 74 displaced in relation to the slats 69 of the upper table 59. The slats 74 are separated by spaces 75 in order to deflect the small quantity of white water that is pressed out of the web in a downward direction. These spaces 75 are located opposite the slats 69 of the upper table 59, whereas the spaces 68 of the upper table 59 are located opposite the slats 74 of the lower table 60 in an overlapping relationship. The slats 74 of the lower table 60 are mutually adjustable in vertical direction so that their pressure against the fourdrinier wire 6 can be regulated. In the embodiment shown the slats 74 rest on rubber tubes 76 in which the air pressure can be regulated.

The slats 74 are carried by a stand 77 as seen in FIG. 2 via upper and lower U-beams 78, 79 enclosing the rubber tube 76 so that it can press the upper U-beam 78 and its slat 74 in an upward direction. The passage between the tables 59 and 60 converges in the direction of travel of the fourdrinier wire 6, the convergence being regulated by the inclination of the upper table 59 by means of adjustment means 63. This convergence, not shown in detail in FIG. 3, controls the amount of water remaining in the core in order to retain a fluidized state in the core. The slats with the inclined surfaces 80, 81 contribute to enough water being retained in the stock layer 3 during its forming to prevent the fibers from "freezing".

The slats 69 of the upper table 59 within said leading straight zone 72 and the slats 74 of the lower table 60 have inclined surfaces 80, 81 facing the wires 6, 26 and converging in the direction of travel of the wires 6, 26, so that each slat 69, 74 has a downstream end portion 82 along which the wires 6, 26 slide, and an upstream end portion 83 which is not in contact with the wires 6, 26. The inclined slat surfaces 80, 81 form an angle $\alpha$ of 5–25°, preferably 10–15°, with a reference plane that intersects the downstream end portions 82 of the slat surfaces 80, 81.

As shown in FIG. 4, the dewatering means in the third forming unit 34 comprise a leading suction box 85 arranged below the fourdrinier wire 6 at the beginning of the run 39 of the top wire 36 along the fourdrinier wire 6, and a separation suction box 86 arranged below and along the fourdrinier wire 6 at the end of the run 39 of the top wire 36 where the top wire 36 leaves the fourdrinier wire 6, so that the three-layer web 2, 3, 4 accompanies the fourdrinier wire 6 forwards. Said two suction boxes 85, 86 have curved surfaces 87, 88, along which the fourdrinier wire 6 slides, the downstream end of the leading suction box 85 and the upstream end of the separating suction box 86 being arranged below a reference plane at a tangent to the breast roll 7 and suction couch 8.

The dewatering means also comprise an upper dewatering table 89 located in the loop of the top wire 36, and a lower dewatering table 90 located in the loop of the fourdrinier wire 6. The tables 89, 90 define a passage between them, through which the fourdrinier wire 6 and top wire 36, enclosing the three-layer web 2, 3, 4 between them, pass in sliding contact with the tables 89, 90. The upper table 89 is arranged on the lower side of a housing 91 suspended in a stand 92 via adjustment means 93 enabling the upstream and downstream ends of the table 89 to be raised and lowered independently of each other in order to incline the table 89 in relation to a reference plane at a tangent to the breast roll 7 and suction couch 8, and also enabling the table 89 as a whole to be lowered and set at a level below said reference plane so that the top wire 36 and fourdrinier wire 6 are bent downwards and brought into sliding contact with the curved surfaces 87, 88 of the suction boxes 85, 86.

In the embodiment shown, the housing 91 comprises four suction chambers 94, 95, 96, 97 to collect the white water pressed up through the top wire 36 due to the suction action. The upper table 89 comprises a plurality of slats 99, fixed in relation to the housing 91 and separated by spaces 98, whereby each suction chamber, except for the first one, is in open communication with its own group of spaces 98 in order to suck up the white water pressed out of the underliner 4 through the top wire 36.

The upstream end of the upper table 89 has a slat 100 which scrapes gently against the top wire 36 in order to deflect the white water that collects on the upper side of the top wire as it passes said leading suction box 85, to the first suction chamber 94 via an autoslice (not shown). The upper table 89 has a first or leading straight zone 102 and a second or final curved zone 103 with large radius.

The lower table 90 is located opposite the leading straight zone 102 of the upper table 89, and comprises a plurality of slats 104 displaced in relation to the slats 99 of the upper table 89. The slats 104 are separated by spaces 105 in order to deflect the small quantity of white water that is pressed out of the web in a downward direction. These spaces 105 are located opposite the slats 99 of the upper table 89, whereas the spaces 98 of the upper table 89 are located opposite the slats 104 of the lower table 90 in an overlapping relationship. The slats 104 of the lower table 90 are mutually adjustable in a vertical direction so that their pressure against the fourdrinier wire 6 can be regulated. The slats 104 are influenced by rubber tubes (not shown) in which the air pressure can be regulated. The slats 104 are carried by a stand 107 via elements 108 similar to the beams 78, 79 in FIG. 3, said elements enclosing the rubber tubes to press the slats 104 in an upward direction. The passage between the tables 89, 90 converges in the direction of travel of the fourdrinier wire 6, the convergence being regulated by the inclination of the upper table 89 by means of adjustment means 93. This convergence controls the amount of water to remain in the underliner.

If desired, an additional forming unit may be used for forming the core, in which case it may have the same design as the second forming unit described above.

That which is claimed is:

1. A method of manufacturing a paperboard web having a back layer, a core layer, an underliner layer and a top layer, said method comprising the steps of:

a) forming the back layer with a first forming unit on a fourdrinier wire;

b) forming the core layer with a second forming unit comprising the steps of;

supplying stock from a high consistency headbox onto the back layer on the fourdrinier wire, the stock having a consistency of about 1.5–6.0% which creates an uneven surface for the core layer opposite the back layer;

advancing a top wire into contact with the stock on the fourdrinier wire for dewatering the stock therebetween; and advancing the top wire and adjacent fourdrinier wire through upper and lower opposed tables each pressing against a respective one of the wires, each of the tables having spaced slats which are aligned such that the slats of one table are opposite the spaces between the slats of the other table and the stock is maintained in a fluidized state by the alternate pressure pulses and shear forces created by the slats;

c) forming the underliner layer with a third forming unit comprising the steps of;

supplying stock from a low consistency headbox onto the core and back layers on the fourdrinier wire, the stock having a consistency of about 0.3–1.4% so as to even out the uneven surface of the core layer with the fibers of the underliner layer;

advancing a top wire into contact with the stock on the fourdrinier wire for dewatering the stock therebetween; and advancing the top wire and adjacent fourdrinier wire through upper and lower opposed tables each pressing against a respective one of the wires, each of the tables having spaced slats which are aligned such that the slats of one table are opposite the spaces between the slats of the other table and the stock is maintained in a fluidized state by the alternate pressure pulses and shear forces created by the slats; and d) forming the top layer over said underliner layer.

2. A method as claimed in claim 1 wherein the step of advancing the top wire and the adjacent fourdrinier wire through the tables of the second forming unit further comprises providing the slats with inclined surfaces adjacent to the respective wire such that only the downstream end portions of each slat contact the adjacent wire as they are advanced between the tables.

3. A method as claimed in claim 1 wherein the step of forming the back layer further comprises the steps of:

supplying stock from a low consistency headbox onto the fourdrinier wire, the stock having a consistency of about 0.2–0.6%;

advancing the fourdrinier wire over at least one suction box for dewatering the stock on the wire.

4. A method as claimed in claim 1 wherein the dewatering of the stock in the forming units causes the formed web to have a consistency of about 6–15%.

5. A method as claimed in claim 4 wherein the dewatering of the stock in the forming units causes the formed web to have a consistency of about 8–12%.

6. A method as claimed in claim 1 wherein the consistency of the stock forming the core layer is about 2.5–3.5%.

7. A method as claimed in claim 1 wherein the consistency of the stock forming the underliner layer is about 0.5–1.0%.

8. A board machine for manufacturing a paperboard web having a back layer, a core layer, an underliner layer and a top layer, said machine comprising:

a fourdrinier wire running in a loop over a breast roll and suction couch;

a first forming unit for forming the back layer on the fourdrinier wire;

a second forming unit for forming the core layer on the back layer, said second forming unit comprising;

a headbox for stock with a consistency of about 1.5–6.0% which creates an uneven surface for the core layer opposite the back layer;

a top wire running in a loop and having a run cooperating with the fourdrinier wire;

a suction chamber housing located in the loop of the top wire;

an upper table supported on the lower side of said suction chamber housing and having a plurality of slats arranged thereon in a spaced apart relationship; and a lower table supported on a stand in the loop of the fourdrinier wire, said lower table having a plurality of slats arranged thereon in a spaced apart relationship and aligned with the slats of said upper table such that the slats of one table are opposite the spaces between the slats of the other table and the stock is dewatered therebetween;

a third forming unit for forming the underliner layer on the core and back layers, said third forming unit comprising;

a headbox for stock with a low consistency of about 0.3–1.4% so as to even out the uneven surface of the core layer with the fibers of the underliner layer;

a top wire running in a loop and having a run cooperating with the fourdrinier wire;

a suction chamber housing located in the loop of the top wire;

an upper table supported on the lower side of said suction chamber housing and having a plurality of slats arranged thereon in a spaced apart relationship; and a lower table supported on a stand in the loop of the fourdrinier wire, said lower table having a plurality of slats arranged thereon in a spaced apart relationship; and a fourth forming unit for forming the top layer.

9. A board machine as claimed in claim 8 wherein the slats of the tables of the second forming unit have surfaces inclined relative to a line drawn tangent to said breast roll and suction couch such that the surfaces converge in the direction of travel of the wires.

10. A board machine as claimed in claim 9 wherein the surfaces are inclined about 5–25° relative to said tangent line.

11. A board machine as claimed in claim 10 wherein the surfaces are inclined about 10–15° relative to said tangent line.

12. A board machine as claimed in claim 8 wherein said first forming unit comprises:

a headbox for stock with a low consistency of about 0.2–0.6% positioned adjacent to said breast roll; and at least one suction box arranged downstream of said headbox for dewatering the stock.

13. A board machine as claimed in claim 8 wherein the headbox of said second forming unit is configured for stock with a consistency of about 2.5–3.5%.

14. A board machine as claimed in claim 8 wherein the headbox of said third forming unit is configured for stock with a consistency of about 0.5–1.0%.

15. A method of manufacturing a paperboard web having a back layer, a core layer, an underliner layer and a top layer, said method comprising the steps of:

a) forming the back layer with a first forming unit on a fourdrinier wire;

b) forming the core layer with a second forming unit comprising the steps of;

supplying stock from a high consistency headbox onto the back layer on the fourdrinier wire, the stock having a consistency of about 1.5–6.0%;

advancing a top wire into contact with the stock on the fourdrinier wire for dewatering the stock therebetween; and advancing the top wire and adjacent fourdrinier wire through upper and lower opposed tables each pressing against a respective one of the wires, each of the tables having spaced slats which are aligned such that the slats of one table are opposite the spaces between the slats of the other table and the stock is maintained in a fluidized state by the alternate pressure pulses and shear forces created by the slats;

c) forming the underliner layer with a third forming unit comprising the steps of;

supplying stock from allow consistency headbox onto the core and back layers on the fourdrinier wire, the stock having a consistency of about 0.3–1.4%;

advancing a top wire into contact with the stock on the fourdrinier wire for dewatering the stock therebetween; and advancing the top wire and adjacent fourdrinier wire through upper and lower opposed tables each pressing against a respective one of the wires, each of the tables having spaced slats which are aligned such that the slats of one table are opposite the spaces between the slats of the other table and the stock is maintained in a fluidized state by the alternate pressure pulses and shear forces created by the slats; and d) forming the top layer over said underliner layer with a fourth forming unit comprising the steps of:

supplying stock from a low consistency headbox onto a second fourdrinier wire, the stock having a consistency of about 0.2–0.6%;

advancing the second fourdrinier wire over at least one suction box to dewater the stock of the top layer;

advancing the second fourdrinier wire into proximity with the first fourdrinier wire such that the top layer is adjacent the underliner layer;

couching the top layer together with the underliner, core and back layers to thereby create a paperboard web having four layers.

16. A board machine for manufacturing a paperboard web having a back layer, a core layer, an underliner layer and a top layer, said machine comprising:

a fourdrinier wire running in a loop over a breast roll and suction couch;

a first forming unit for forming the back layer on the fourdrinier wire;

a second forming unit for forming the core layer on the back layer, said second forming unit comprising;

a headbox for stock with a consistency of about 1.5–6.0%;

a top wire running in a loop and having a run cooperating with the fourdrinier wire;

a suction chamber housing located in the loop of the top wire;

an upper table supported on the lower side of said suction chamber housing and having a plurality of slats arranged thereon in a spaced apart relationship; and a lower table supported on a stand in the loop of the fourdrinier wire, said lower table having a plurality of slats arranged thereon in a spaced apart relationship and aligned with the slats of said upper table such that the slats of one table are opposite the spaces between the slats of the other table and the stock is dewatered therebetween;

a third forming unit for forming the underliner layer on the core and back layers, said third forming unit comprising;

a headbox for stock with a low consistency of about 0.3–1.4%;

a top wire running in a loop and having a run cooperating with the fourdrinier wire;

a suction chamber housing located in the loop of the top wire;

an upper table supported on the lower side of said suction chamber housing and having a plurality of slats arranged thereon in a spaced apart relationship; and a lower table supported on a stand in the loop of the fourdrinier wire, said lower table having a plurality of slats arranged thereon in a spaced apart relationship; and a fourth forming unit for forming the top layer, said fourth forming unit comprising:

a headbox for stock with a low consistency of about 0.2–0.6%;

a second breast roll adjacent said headbox of said fourth forming unit;

a second fourdrinier wire running in a loop over said second breast roll;

at least one suction box arranged below said second fourdrinier wire for dewatering the stock;

a lower guide roll for advancing said second fourdrinier wire adjacent to said first fourdrinier wire and couching together the top layer with the formed three-layer web to form the finished four-layer web; and a suction box arranged below the first fourdrinier wire downstream of said lower guide roll to ensure that the thus formed four-layer web does not follow said second fourdrinier wire of said fourth forming unit.

* * * * *

UNITED STATES PATENT AND TRADEMARK OFFICE
CERTIFICATE OF CORRECTION

PATENT NO. : 5,935,382

DATED : August 10, 1999

INVENTOR(S) : Huovila et al.

It is certified that error appears in the above-identified patent and that said Letters Patent is hereby corrected as shown below:

On the title page, [56] References Cited, U.S. PATENT DOCUMENTS, line 8, "5,190,090" should read --5,196,090--.

Column 9, line 7, "allow" should read --a low--.

Signed and Sealed this

Eleventh Day of April, 2000

*Attest:*

*Attesting Officer*

Q. TODD DICKINSON

*Director of Patents and Trademarks*